United States Patent [19]

Saito et al.

[11] Patent Number: 4,732,095

[45] Date of Patent: Mar. 22, 1988

[54] SEWING MACHINE FOR AUTOMATICALLY SEWING NEAT SEAM ENDS

[75] Inventors: Kazuo Saito, Hachioji; Sumio Goto, Tokyo; Jiro Ishibashi, Tokyo; Masakazu Nemoto, Tokyo, all of Japan

[73] Assignee: Tokyo Juki Industrial Co., Ltd., Tokyo, Japan

[21] Appl. No.: 858,954

[22] Filed: May 2, 1986

[30] Foreign Application Priority Data

Apr. 27, 1985 [JP] Japan ..... 60-91724

[51] Int. Cl.[4] ..... D05B 19/00; D05B 27/22

[52] U.S. Cl. ..... 112/121.11; 112/275; 112/315; 112/272

[58] Field of Search ..... 112/275, 277, 315, 262.1, 112/2, 272, 306, 314, 121.11, 121.12

[56] References Cited

U.S. PATENT DOCUMENTS

| | | | |
|---|---|---|---|
| 2,440,031 | 4/1948 | Wainwright | 112/303 |
| 3,015,290 | 1/1962 | Hale | 112/315 |
| 3,363,594 | 1/1968 | Kosrow | 112/317 |
| 4,116,143 | 9/1978 | Manabe | 112/121.11 |
| 4,276,841 | 7/1981 | Weisz | 112/317 |
| 4,359,953 | 11/1982 | Martell et al. . | |
| 4,381,719 | 5/1983 | Goldbeck | 112/275 X |
| 4,403,558 | 9/1983 | Martell et al. . | |
| 4,404,919 | 9/1983 | Mortell et al. | 112/315 X |
| 4,491,080 | 1/1985 | Hager | 112/275 |
| 4,495,877 | 1/1985 | Willenbacher | 112/275 X |
| 4,526,114 | 7/1985 | Martell et al. | 112/275 X |
| 4,528,923 | 7/1985 | Hager | 112/275 |
| 4,602,577 | 7/1986 | Kothe et al. | 112/275 X |

FOREIGN PATENT DOCUMENTS

| | | |
|---|---|---|
| 3018797 | 11/1981 | Fed. Rep. of Germany . |
| 3537923 | 10/1985 | Fed. Rep. of Germany . |
| 8515772 | 10/1985 | France . |
| 29714 | 7/1980 | Japan . |
| 59-225449 | 10/1984 | Japan . |

OTHER PUBLICATIONS

Webster's New World Dictionary, 1972, p. 1475.

*Primary Examiner*—Peter Nerbun

*Attorney, Agent, or Firm*—Abelman Frayne Rezac & Schwab

[57] ABSTRACT

A sewing machine automatically sews a seam which ends at a desired point. The last n stitches, preferably the last two stitches, are of substantially equal length. A counter counts pulses while the work is being fed to the needle. The machine detects when the trailing edge of the work passes by a predetermined location ahead of the needle. Upon such detection, the contents of the counter are used to calculate the proper stitch pitch for the last two stitches. The stitch pitch is varied as necessary during sewing of the last two stitches in the seam.

4 Claims, 17 Drawing Figures

| NO. OF PULSES \ PITCH (mm) | 2.5 | 2.25 | 2.0 | 1.75 | 1.5 | 1.25 | 1.0 |
|---|---|---|---|---|---|---|---|
| 0 | 100 | 100 | 100 | 100 | 100 | 100 | 100 |
| 1 | 100 | 100 | 100 | 100 | 100 | 100 | 100 |
| 2 | 100 | 100 | 100 | 100 | 100 | 100 | 100 |
| 3 | 100 | 100 | 100 | 100 | 99 | 99 | 99 |
| 40 | 71 | 70 | 69 | 68 | 64 | 59 | 54 |
| 41 | 70 | 69 | 67 | 67 | 63 | 58 | 53 |
| 81 | 0 | 0 | 0 | 0 | 0 | 0 | 0 |
| 82 | 0 | 0 | 0 | 0 | 0 | 0 | 0 |
| 83 | 0 | 0 | 0 | 0 | 0 | 0 | 0 |

SEWING MACHINE FOR AUTOMATICALLY SEWING NEAT SEAM ENDS

BACKGROUND OF THE INVENTION

The invention relates to sewing machines, and more particularly relates to automatic sewing machines which are used in commercial or industrial applications to sew, e.g., label seams, collar seams and pocket seams.

These seams are examples of seams which should be neatly sewn because of the attention paid to them. For example, in the case of a shirt pocket, the corners of the seams which attach the pocket to the shirt should be equally spaced from the edge of the pocket. If one corner is closer to this edge, the pocket workmanship appears sloppy.

Various measures have been proposed to end a seam at the desired location. For example, it is known to abruptly cease feeding the work when the needle is positioned directly over the desired seam end point, and it is also known to vary the pitch of the last stitch in the seam and to operate the reverse mechanism of the machine in order to terminate the seam at the desired location.

These known measures are not entirely satisfactory. This is because the seam will have normally sized stitches at its beginning and middle, and will have a much shorter stitch at its end, with an abrupt change between these stitches of different lengths. This abrupt change detracts from the appearance of e.g. the pocket or collar seam.

One object of the invention is to provide a device which will automatically end a seam at a predetermined location in a neat and attractive manner.

Another object is to provide a device which will make the difference between the length of stitches at the end of the seam and the length of stitches at the beginning and middle of the seam less conspicuous.

Still another object is to provide a device which is reliable and manufacturable at reasonable cost.

A further object is, in general, to improve on known devices of this type.

In accordance with the invention, there is provided a sewing machine which sews the last n stitches of a seam in such a manner that the seam ends at a predetermined point and the n stitches have substantially equal lengths. This is accomplished by monitoring the position of the work, e.g. the pocket or the collar, as by monitoring the work for detection of its trailing edge. When a predetermined spaced relation exists between the sewing needle and the desired endpoint of the seam, the number of stitches needed to sew to the end of the seam is computed, and stitch pitch is varied as the seam is completed. The variation is carried out in such a manner that the last n stitches in the seam are equally long and end at the desired end point.

In preferred embodiments, the lengths of the last two stitches of the seam are substantially equalized and the pitch of the previous stitches is at its maximum value as established by the operator. Advantageously, a pulse generator generates pulses in synchronism with the main shaft of the sewing machine and the pulses are counted during those times when the feed dog is feeding the work toward the needle. When the trailing edge of the work is detected, the number of pulses counted at the time of detection is used to determine the pitch of the last two stitches in the seam.

BRIEF DESCRIPTION OF THE DRAWINGS

A preferred embodiment of the invention is illustrated in the exemplary and non-limiting drawings, in which.

DETAILED DESCRIPTION OF PREFERRED EMBODIMENTS

Introduction and Functional Description

Figure 1:
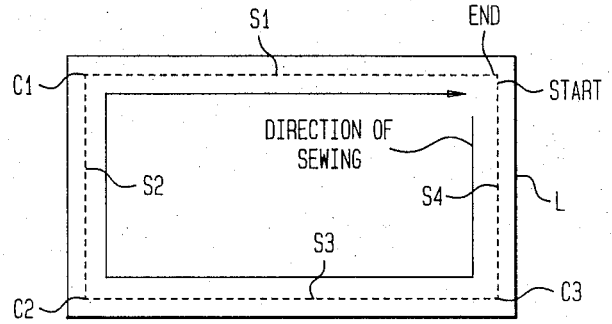
FIG. 1 is an illustration of a seam of the type which is to be sewn by the invention.

Throughout the description, all elements are indicated by the same reference numerals in all the various Figures.

In FIG. 1 are shown four seams S1, S2, S3 and S4 for a label L which is sewn to a shirt (not shown). As shown, seams S4, S3, S2 and S1 make a rectangle which ideally ends at its starting point after passing through three right-angled corners C3, C2 and C1.

In an application such as the one illustrated, the corners should be at equal margins from (i.e. equidistant from the edges of) the label L. For this to be so, each of the corners C1, C2 and C3 as well as the starting and ending point must be located at the precise position desired.

Figure 2:
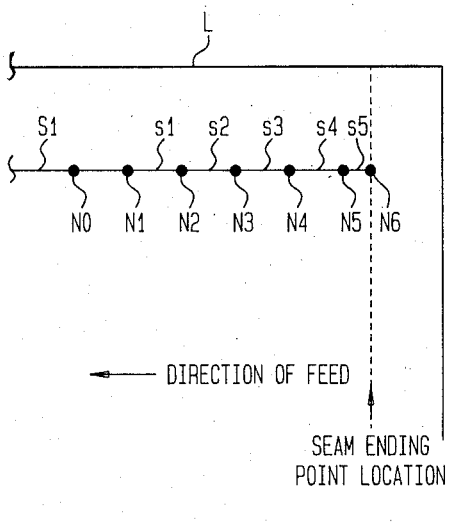
FIG. 2 (PRIOR ART)
FIG. 2 is an illustration of a seam end such as is produced by conventional devices.

However, this precise positioning will not by itself insure a neat appearance of the label seams. FIG. 2, shows that using a conventional sewing machine, the seam end of e.g. seam S1 in the example given is located at the proper location, but is also uneven because of the abrupt change in stitch length used to sew the seam. In FIG. 2, reference numerals N1, N2, . . . N6 indicate the locations of the ends and beginnings of individual stitches; stitch s1 begins at point N1 and ends at point N2, stitch s2 begins at point N2 and ends at point N3, and so on. As shown, stitch s5 is much shorter than any of the other stitches in the seam, and this abrupt change in length yields an unsatisfactory appearance.

Figure 3:
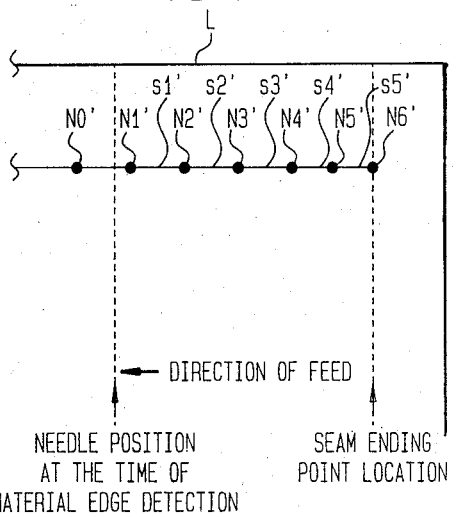
FIG. 3 is an illustration of a seam end such as is produced in accordance with the invention.

FIG. 3 shows the results produced by the preferred embodiment of the invention. Here, while the lengths of stitches s1', s2' etc. are equal, the lengths of stitches s4' and s5' are likewise at least substantially equal, both being shorter than e.g. stitch s3' but being appreciably longer than stitch s5 in FIG. 2. It will be understood that while the length of the last two stitches is varied in the preferred embodiment of the invention, this is only preferred and the length of the last three or more stitches can be varied instead.

In the preferred embodiment of the invention, the machine is initially programmed to sew the desired seams before the sewing actually begins. In this programming, the lengths of the seams, the margins of seams (i.e. the spacing between the endpoint of the seams and the trailing edge of the work) and other necessary data are input to the machine. Sewing then begins, and at some point during the sewing process the machine begins to look for the trailing edge of the work. The pitch of the stitch (i.e. the distance by which the work travels forward towards the needle of the machine) is varied in accordance with the configuration of the feeding mechanism at the time that the trailing edge of the work is detected; at this time the needle is in a predetermined spaced relation with the desired endpoint of the seam to be sewn. The seam is then advantageously finished up at lower speed.

The programming of the preferred embodiment and the entry of data will be described immediately below. Next, the mechanics of the feeding mechanism by which the stitch pitch is varied will be discussed. Thereafter, the manner in which the trailing edge of the work is detected will be described. Finally, there will be a discussion of the electronic control system which drives the feeding mechanism and a description of the steps involved in ending a seam.

The discussion below will omit any discussion of the operation of the sewing needle and the thread feed, since these are conventional and are known to those skilled in the art.

Programming and Data Entry

Figure 15:
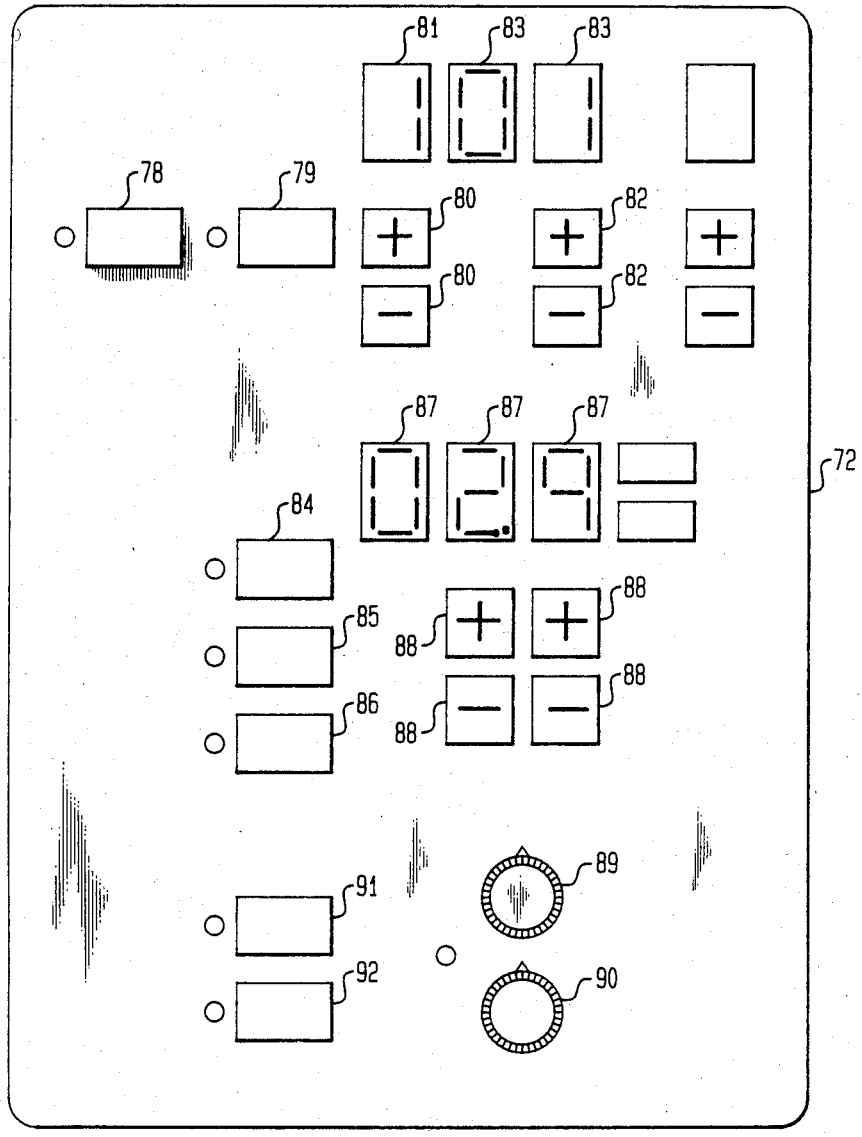
FIG. 15 is a representation of the I/O panel and the controls which are used to enter data into the preferred embodiment.

FIG. 15 illustrates the structure of the I/O panel 72 by which data is entered into and read out of the preferred embodiment. The preferred embodiment is programmable to sew seams in accordance with a plurality of programs; one program might for example be the seams for a particular pocket and another might for example be the seams for a particular label. The key 79 is used to select a program; the plus and minus keys 80 are respectively used to increase and decrease the number of the program and the display 81 indicates the number of the program selected.

Each program contains enough information to sew the necessary number of seams; the program to sew the label illustrated in FIG. 1 would contain enough information to sew four seams. Each seam is considered a program segment; the keys 82 are used to select a particular segment and the number of the segment selected is displayed in displays 83.

There are three modes in which operation of the preferred embodiment can be programmed. In the first mode, the machine is programmed to sew a predetermined number of stitches without regard to the detection of the trailing edge of the work. This mode is selected by turning on the key 84. The display 87 then displays the number of stitches to be sewn, and the keys 88 are used to vary the number of stitches.

In the second mode, which is selected by turning on the key 85, monitoring the work for the trailing edge is disabled for a predetermined number of stitches, after which the machine begins to look for the trailing edge. The number of stitches is then displayed on the display 87, and can be changed by operation of the keys 88.

In the third mode, which is selected by turning on the key 86, the desired margin for the seam end is selected so the desired endpoint of the seam is registered in the machine. The margin is then displayed in mm to one decimal place on the display 87, and can be changed by operation of the keys 88.

The preferred embodiment includes a thread cutter (not shown) for cutting the thread at the end of a particular seam. Where the key 91 is turned on, a program is registered in the machine and the machine cuts the thread after the program has been finished. Where the key 92 is turned on, the program is also registered in the machine but the thread is not cut at the end of the program.

Indicator lamps adjacent the keys 78, 79, 84, 85, 86, 91 and 92 indicate the on or off status of the associated key.

The knobs 89 and 90 are used for coarse and fine adjustment of the sensitivity adjustment circuit 58 discussed below.

The Feeding Mechanism

Figure 4:
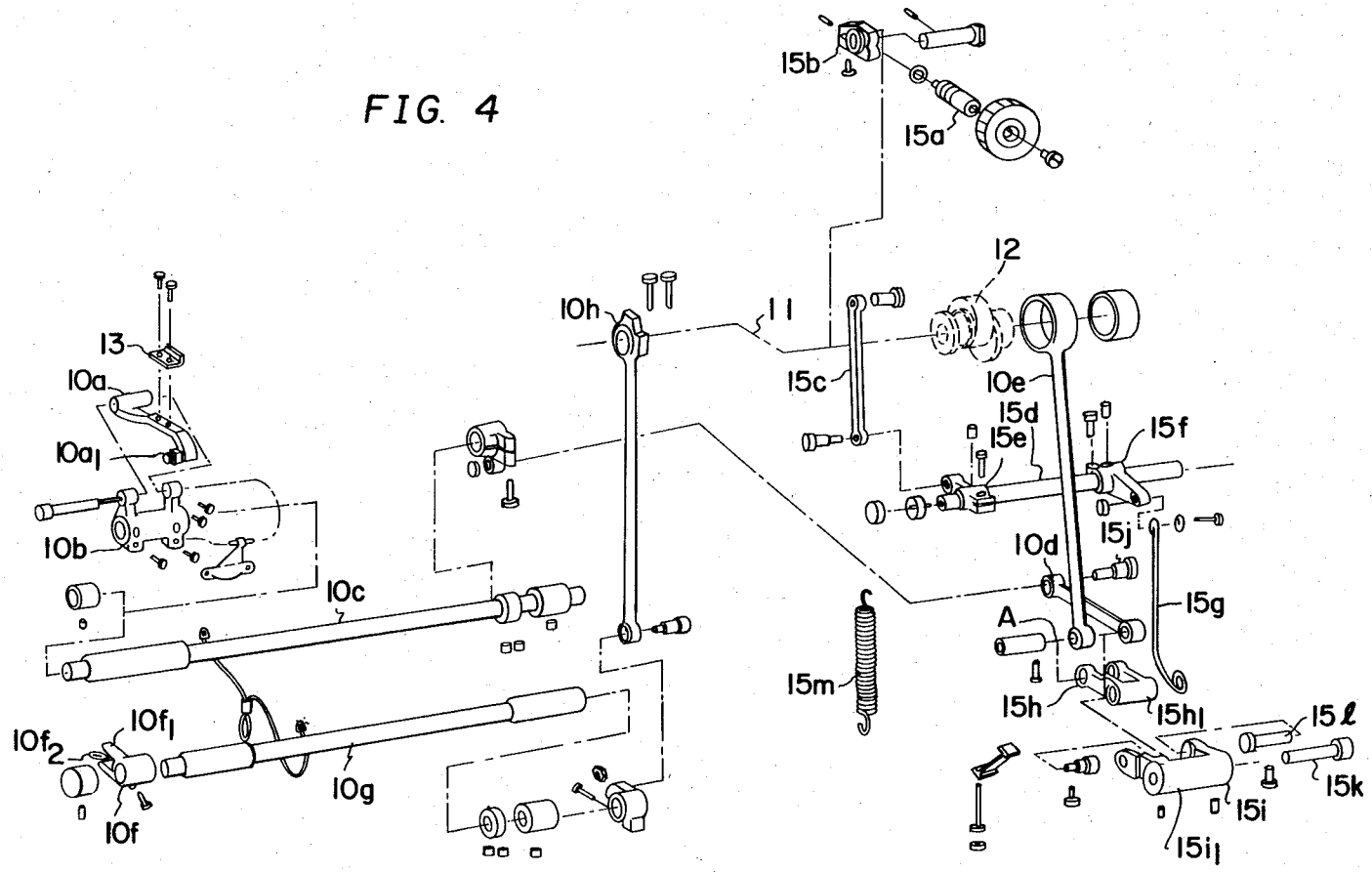
FIG. 4 is an illustration of the feeding mechanism of a preferred embodiment of the invention.
Figure 8:
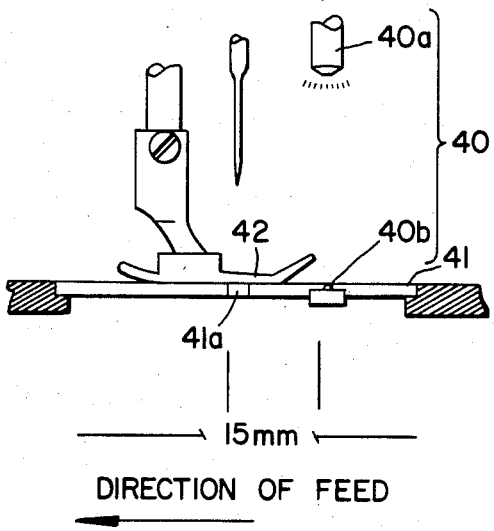
FIGS. 8 and 8*a* show apparatus which is used in the preferred embodiment to detect the trailing edge of the work.

FIG. 4 shows a feed dog 13 which feeds the work (not shown here) towards the sewing needle (also not shown here but illustrated in FIG. 8). The feed dog 13 moves in an elliptical fashion; as it moves vertically up and down under a throat plate (shown at 41 in FIG. 8) it comes into and out of contact with the work and squeezes the work against a presser foot (42 in FIG. 8) of the machine. As the feed dog 13 moves horizontally forward, it advances the work towards the needle; as the feed dog 13 moves horizontally backward, it is normally out of engagement with the work (although it may be desired to drive the work in reverse, and this can be accomplished by driving the feed dog 13 in reverse so that it feeds work only when moving backward).

The sewing machine motor (55 in FIG. 9) rotates the main shaft, which is schematically shown as the broken line 11. An eccentric cam mechanism 12 and a connecting rod 10*h* are connected to the main shaft 11. The vertical motion of the feed dog 13 is derived from the motion of the connecting rod 10*h*; the horizontal motion of the feed dog 13 is derived from the motion of connecting rod 10*e*, which is driven off the cam mechanism 12.

Derivation of Vertical Feed Dog Motion

As the main shaft 11 rotates, the connecting rod 10*h* rocks. This rotates a shaft 10*g*, which has a lever 10*f* at its end. The lever 10*f* has two forks 10*f*1 and 10*f*2; the tongue 10*a*1 of the feed bar 10*a* fits between these two forks 10*f*1 and 10*f*2. Therefore, as the main shaft 11 rotates, the shaft 10*g* rotates, the lever 10*f* rocks, and the feed dog 13 is moved up and down.

Derivation of Horizontal Feed Dog Motion

The motion of the connecting rod 10*e* is transmitted to connecting rod 10*d*, which moves horizontally. The connecting rod 10*d* is secured to a shaft 10*c*, which likewise moves horizontally. This horizontal motion is imparted in turn to a feed rocker 10b, a feed bar 10a and thence to the feed dog 13. Therefore, as the main shaft 11 rotates, the feed dog 13 moves back and forth.

Changing of Stitch Pitch

A mechanism is provided to change the stitch pitch, i.e. the distance which the work is moved forward by the feed dog 13 for each rotation of the main shaft 11. This is done by varying the horizontal component of motion of the feed dog 13; the vertical component of motion is unchanged. The change can be accomplished manually by an operator or automatically.

To change the stitch pitch, a shaft 15d is rotated. The effect of this, as will be seen below, is to change the way in which the distal end of the connecting rod 10e (i.e. that end of the connecting rod 10e which is remote from the main shaft) moves the connecting rod 10d during rotation of the main shaft 11.

Connecting rod 10e and connecting rod 10d are pivotally connected to each other and this connection allows rotation about axis A. A link pin 15h is likewise mounted to this connection so as to be pivotable about axis A as well. The end 15h1 of the link pin 15h which (the end 15h1 is remote from axis A) is pivotally secured to one side 15i1 of a hinge pin 15i by a pin 15k. The other side 15i2 of the hinge pin 15i is pivotally secured to rotate about an axis which is fixed with respect to the machine. The pin 15k pivotally secures one end of a curved connecting rod 15g to the link pin 15h and the hinge pin 15i; the other end of the connecting rod 15g is pivotally secured to a lever arm 15f which is in turn secured to the shaft 15d.

Figure 5A:
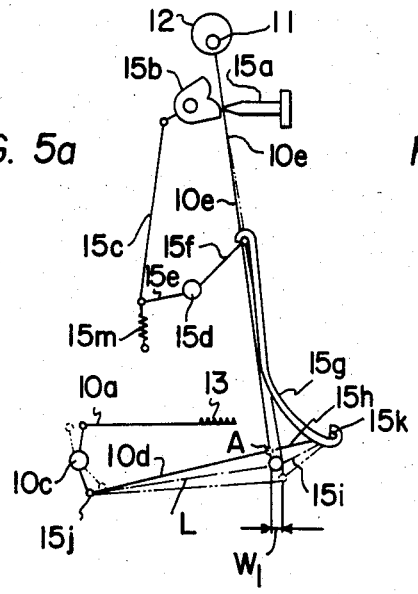
FIGS. 5*a* and 5*b* illustrate two configurations of the feeding apparatus in the preferred embodiment whereby two different stitch pitches are produced.
Figure 5B:
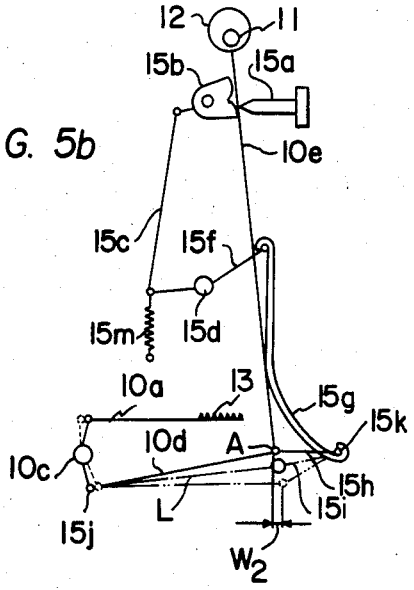

The geometry of this arrangement is illustrated in FIGS. 5a and 5b. When the shaft 15d is rotated, this moves the connecting rod 15g. This movement is reflected in a relative movement between the link pin 15h and the hinge pin 15i. Because the movement of the connecting rod 10d in response to the movement of the connecting rod 10e is constrained by the link pin 15h and the hinge pin 15i, a relative movement between these two elements changes the way in which the connecting rod 10d is moved as a result of rotation of the main shaft 11. The effect of the change is illustrated in FIGS. 5a and 5b.

Line L as drawn in FIGS. 5a and 5b connects the pin 15j with the centers of the hinge pin 15i and the link 15h; the pin 15j connects the connecting rod 10d to the shaft 10c. When, as is illustrated in FIGS. 5a and 5b, the position of pin 15k is changed with respect to line L as a result of the rotation of the shaft 15d, this varies the horizontal component W of the rotation of the hinge pin 15i. Two different configurations of this linkage as shown in FIGS. 5a and 5b give rise to two different horizontal components W1 and W2. This in turn varies the stitch pitch because it changes the horizontal component of motion of the feed dog 13. This is the mechanism whereby rotation of the shaft 15d changes the stitch pitch.

This feeding mechanism is of a known type, and forms no part of the invention.

MANUAL ADJUSTMENT OF STITCH PITCH

Where a user changes the stitch pitch, an adjusting screw 15a is rotated. The adjusting screw 15a bears against an adjusting cam 15b. The cam 15b is attached to a connecting rod 15c, which in turn is connected to the shaft 15d by a rocker arm 15e and to the free end of a tension spring 15m. The spring 15m keeps the cam 15b against the adjusting screw 15a. Therefore, as the adjusting screw 15a is rotated, the cam 15b is rotated and the shaft 15d is rotated along with it.

REVERSE OPERATION OF THE MACHINE

The cam 15b is moved to the other lobe (i.e. the lobe which does not bear against the adjusting screw 15a) when the sewing machine is operated in reverse; in this instance the pin 15k is moved below the line L and the connecting rods 10d and 10e are depicted by the broken lines in FIGS. 5a and 5b.

AUTOMATIC ADJUSTMENT OF STITCH PITCH

As is explained in more detail below, the pitch of stitches sewn by the preferred embodiment is varied in accordance with certain criteria to achieve the desired results and objects. This part of the description will focus upon the mechanical actions by which stitch pitch is changed as a result of electrical signals; the generation of those signals will be explained afterward.

Figure 6:
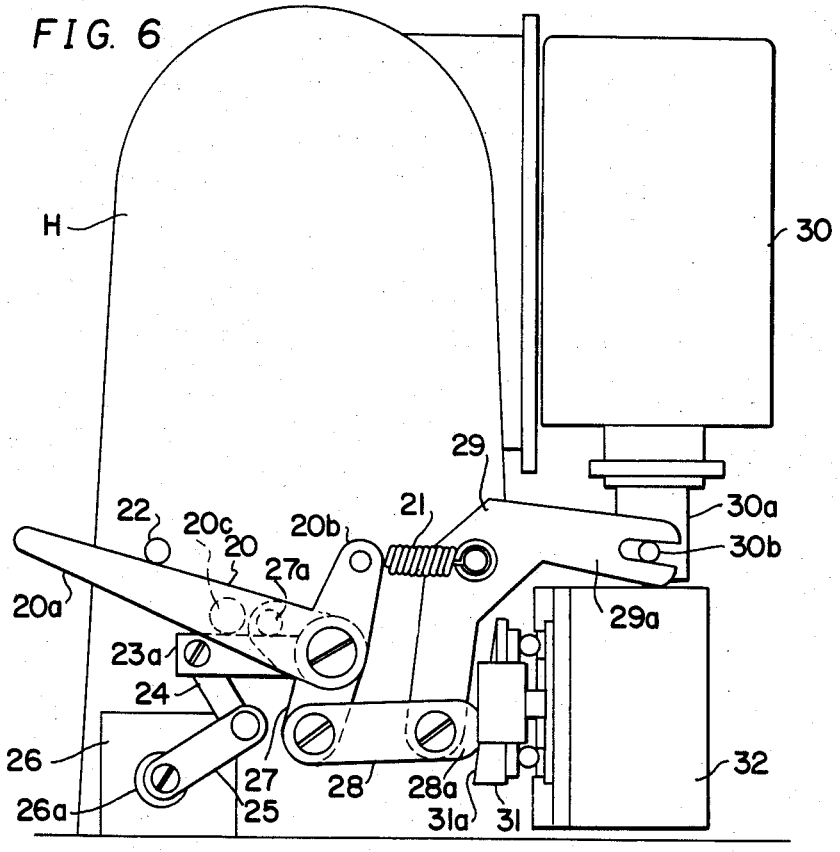
FIG. 6 is an illustration of apparatus which is used to vary the stitch pitch in the preferred embodiment.
Figure 7:
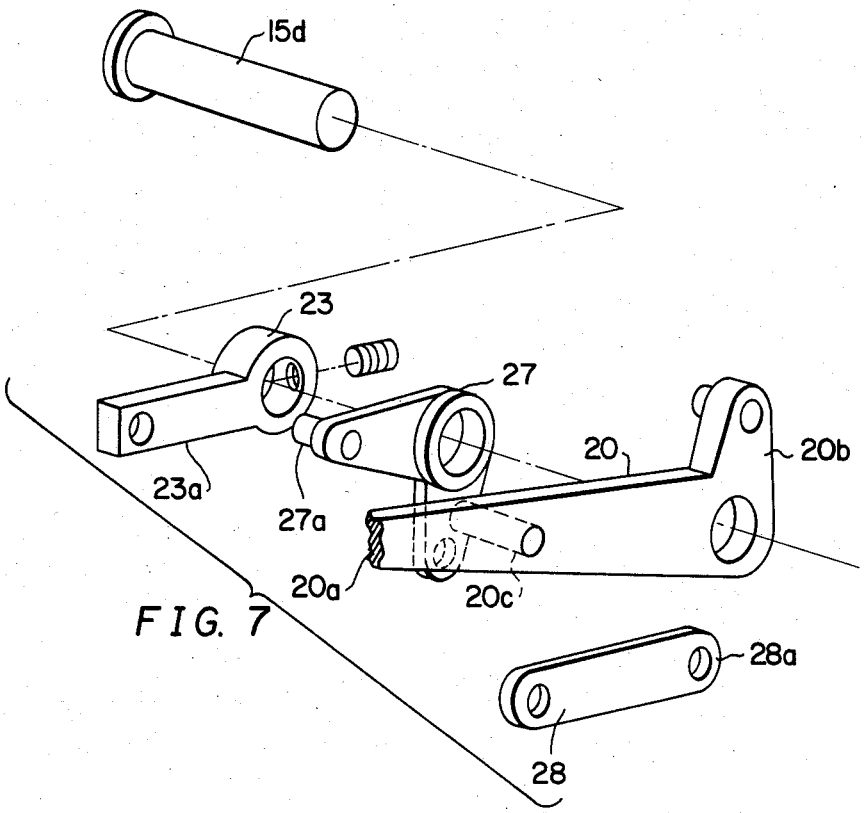
FIG. 7 is a detail view of a part of the apparatus illustrated in FIG. 6.

FIGS. 6 and 7 illustrate the mechanism by which the shaft 15d is rotated and by which the degree of rotation can be controlled. In principle, this mechanism serves (a) to rotate the shaft 15d in response to operation of a stepper motor 32, (b) to change the resistance of a potentiometer 26 in accordance with the stitch pitch selected, and (c) to permit the automatic adjustment to be engaged and disengaged by operation of a solenoid 30.

Referring to FIGS. 6 and 7 together, the shaft 15d projects out of the machine housing H and is fixed to a rocker 23. Adjacent the rocker 23 is a right-angled lever 27; the lever 27 is slid onto the shaft 15d. One arm of the lever 27 bears a pin 27a; this rests on top of a projection 23a of the rocker 23. The other arm of the lever 27 is pivotally secured to one end of an elongated link arm 28.

The end 28a of the link arm 28 (end 28a is remote from the end of the link arm 28 which is attached to the lever 27) is (a) pivotally secured to right-angled bell crank 29 and (b) positioned so that it can be brought into abutment with the stepped face 31a of a cam 31. The cam 31 is rotated by a stepping motor 32. The bell crank 29 is rotated to bring the end 28a into and out of abutment with the cam 31; this rotation is accomplished because the arm 29a of the bell crank 29 is mechanically connected to the plunger 30a of a solenoid 30. This connection is carried out by a pin 30b; the pin 30b is fixed to the plunger 30a and is received within a slot in the arm 29a.

An elongated lever arm 20 is rotatably secured to the shaft 15d adjacent the lever 27. The longer arm 20a of the lever arm 20 supports a pin 20c; this rests upon the top of the projection 23a adjacent the pin 27a. The shorter arm 20b of the lever arm 20 is attached to the free end of a tension spring 21; clockwise (as viewed in FIG. 6) motion of the lever arm 20 is limited by a stop pin 22 which is fixed to the housing H.

This apparatus works as follows. The lever arm 20 is used to adjust the stitch pitch when the apparatus is operated in reverse. Normally, the lever arm 20 is rotated fully clockwise by the spring 21 and abuts the stop pin 22. However, if the longer arm 20 is depressed by an operator, the pin 20c rotates the rocker 23 and thereby rotates the shaft 15d. The end 28a of the link arm 28 is moved to the right as viewed in FIG. 6, until it strikes the face 31a of the cam 31; the bell crank 29 rotates counterclockwise.

When the solenoid 30 is energized to engage the automatic change of the stitch pitch, the plunger 30*a* is drawn up (as viewed in FIG. 6) and the end 28*a* of the link arm 28 is brought to bear against the cam 31. This movement of the link arm 28 causes the lever 27 to rotate counterclockwise as viewed in FIG. 6 and the pin 27*a* bears against the projection 23*a;* this rotates the rocker 23 and thus the shaft 15*d* counterclockwise. As the cam 31 is rotated by the stepper motor 32, the end 28*a* is moved accordingly to the left or right as viewed in FIG. 6, and this motion is reflected in a rotation of the shaft 15*d*. The solenoid 30 holds the end 28*a* against the cam 31 when the solenoid 30 is energized.

The distal end of the projection 23*a* of the rocker 23 is mechanically connected by two links 24 and 25 to the shaft 26*a* of a potentiometer 26. Therefore, the resistance of the potentiometer 26 represents the angular position of the shaft 15*d* and hence the current value of the stitch pitch.

The cam 31 is cut such that 180° rotation adjusts the stitch pitch between 0 mm and 2.5 mm; each step of the stepper motor 32 adjusts the stitch pitch by 0.424 mm.

The Trailing Edge Detector

Figures 8A, 13:
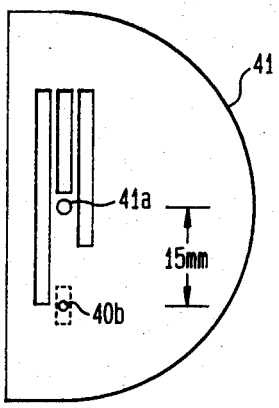
FIG. 13 is a table which is used in the preferred embodiment to determine the percentage of non-accomplishment of feed at the time of detection of the trailing edge of the work.

In this preferred embodiment of the invention the position of the work is monitored by detection of the trailing edge of the work. This is accomplished by using a trailing edge detector 40 which is shown in FIGS. 8 and 8*a*. The trailing edge detector 40 is here made up of a light source 40*a* (which in this example is the incandescent lamp used to illuminate the work) and a photodetector 40*b* (which in this example is a Toshiba TPS 618 phototransistor). The photodetector 40*b* is placed ahead (in this example, 15 mm ahead) of the needle hole 41*a* of the throat plate 41 and is located below a corresponding hole in the throat plate 41 so that light from the source 40*a* can strike it.

When the preferred embodiment of the invention is sewing more than 15 mm ahead of e.g. an edge of a pocket, there are two layers of fabric interposed between the light source 40*a* and the photodetector 40*b*. However, when the trailing edge of the pocket passes by the photodetector 40*b*, there is only one layer of fabric which is so interposed and this is reflected in increased radiation incident upon the phototransistor 40*b* and thus in an increased output therefrom. This increased output is used to "tell" the remaining circuitry disclosed below that the e.g. pocket edge is 15 mm ahead of the needle, so that appropriate measures can be taken to vary the stitch pitch and stop the machine at the desired margin from the edge.

The Electronic Control System

Figure 9:
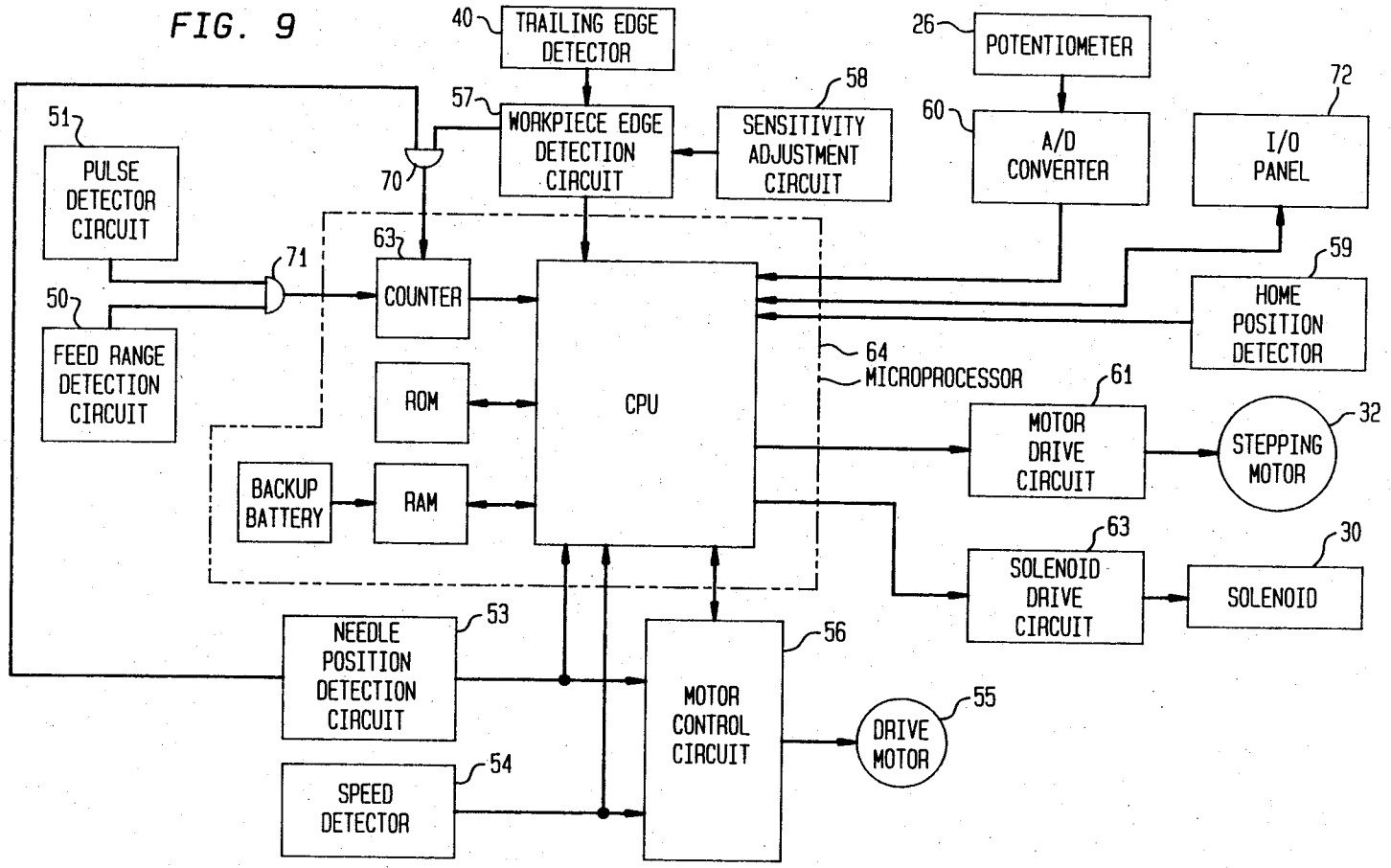
FIG. 9 is a block diagram which schematically shows the electronic components of the preferred embodiment.

The electronic control system of the preferred embodiment will be explained with initial reference to FIG. 9.

The trailing edge detector 40 described above is connected to a workpiece edge detection circuit 57, as is a sensitivity adjustment circuit 58. These circuits are provided because the absolute output of the trailing edge detector 40 does not indicate whether the trailing edge of the work has been encountered. This is because the amount of radiation incident upon the trailing edge detector 40 is determined by e.g. the thickness and finish of the materials being sewn, and the sensitivity adjustment circuit must be set in accordance with the materials in use.

The output of the workpiece edge detection circuit 57 is directed to a gate 70 and a microprocessor 64, which includes a CPU, a battery backed-up RAM, a ROM and a counter 63 which is discussed below. Also directed to the microprocessor 64 is a representation of the current stitch pitch; this is represented by the resistance of the potentiometer 24, which is digitized in an analog-to-digital converter 60 and presented to the microprocessor 64 in digital form.

The stepping motor 32 is driven by a motor drive circuit 61 which is in turn driven by the microprocessor 64. The solenoid 30 is driven by a solenoid drive circuit 63 which is in turn driven by the microprocessor 64. A home position detector 59 is provided to determine when the stepping motor 32 is in its home position; in the preferred embodiment, this is conveniently chosen to be the position in which the stitch pitch is 0, but any other home positions could be used instead.

A motor 55 is provided to drive the main shaft 11. The motor 55 is driven by a drive circuit 56, which is connected to the microprocessor 64. To the main shaft 11 are connected a speed detector 54 and and a needle position detecting circuit 53; both of these are also connected to the drive circuit 56, as well as to the microprocessor 64. The speed detector 54 is here implemented as a tachogenerator, and measures the instantaneous angular velocity of the main shaft 11. The needle position detecting circuit 53 produces a binary signal which indicates whether the needle is at its highest or its lowest point.

A pulse detector circuit 51 is connected to the main shaft 11 and responds to its rotation by generating pulses (here, 160 pulses per complete rotation of the main shaft 11). Also connected to the main shaft 11 is a feed range detection circuit 50. This feed range detection circuit 50 produces a binary signal which represents whether the needle is above or below the throat plate 41. This signal is of importance because the work cannot be fed when it is pierced by the needle. As long as the needle is above the throat plate 41, work feed can take place.

The outputs from the workpiece edge detection circuit 57 and the needle position detecting circuit 53 are directed to the inputs of an OR gate 70, and the outputs from the pulse detector circuit 51 and the feed range detection circuit 50 are directed to the inputs of an AND gate 71. The OR gate 70 and the AND gate 71 are connected to the counter 63 (which is in turn connected to the CPU in the microprocessor 64). The connections are such that the counter 63 counts the pulses which are passed through the AND gate 71 and is reset to a count of zero (after its contents have been registered in the CPU) when the output of the OR gate 70 is high.

The I/O panel 72 discussed above is connected to the microprocessor 64 for inputting and outputting information about the desired endpoint for a seam (or a plurality of seams) to be sewn.

Theory of Operation

In the preferred embodiment, the desired initial stitch pitch, length, margin etc. of a seam are input to the I/O panel 72, and registered in the microprocessor 64. When the trailing edge of the work is detected by the trailing edge detector 40, it can be determined how far ahead from the needle is the desired seam endpoint.

Furthermore, the content of the counter 63 at the moment of trailing edge detection is a measure of the degree of stitch shortening required to cause the last stitch of the seam to end precisely at the desired endpoint. This is because the counter 63 only counts pulses delivered during the feeding cycle of the machine, and the content of the counter 63 is therefore related to the physical position of the work.

In the preferred embodiment, the counter 63 starts to count anew with the beginning of each feed cycle of the feed dog 13 and the stitch pitch is maintained at its maximum value until the trailing edge of the work is detected. Upon such detection, the then-current content of the counter 63 is used to determine the pitch which is to be used for the last two stitches in the seam to be sewn. The stitch pitch is held at its maximum value until the last two stitches, when it is adjusted such that the last two stitches are equally long and the last stitch ends at the desired endpoint. (This adjustment will almost always be a reduction in stitch pitch, since it will only seldom occur that the trailing edge of the work is detected at the precise time that a current stitch is being finished up. However, if this occurs, stitch pitch will be maintained at its maximum value and there will be no difference in length between the last two stitches and the other ones.)

Details of Operation

Figure 10:
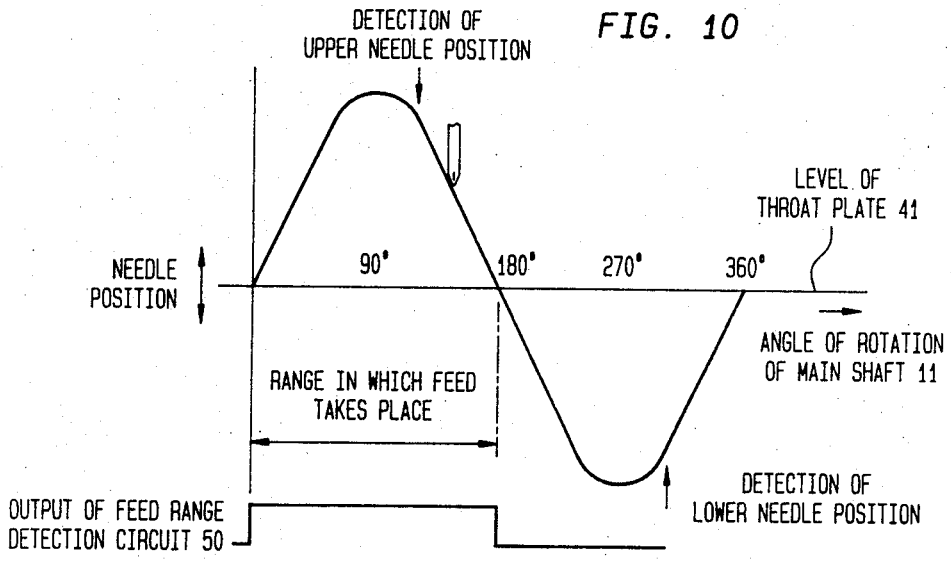
FIGS. 10, 11 and 12 are timing diagrams illustrating operation of various circuits of the preferred embodiment.
Figure 11:
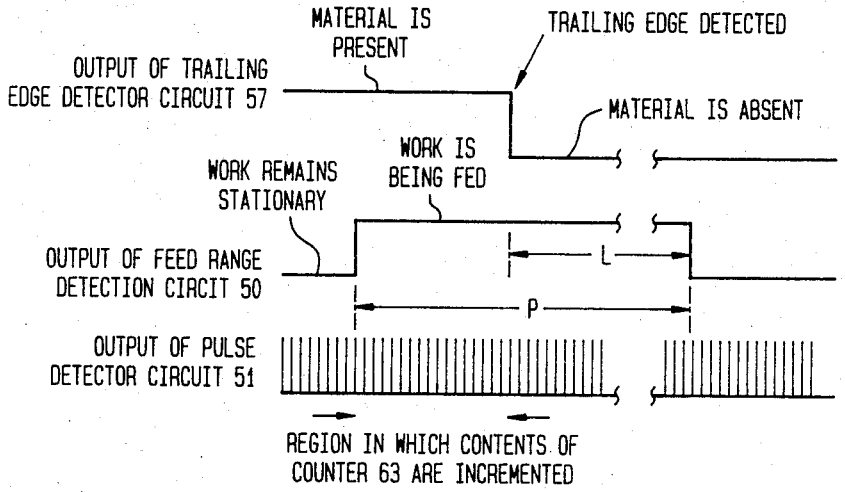
Figure 12:
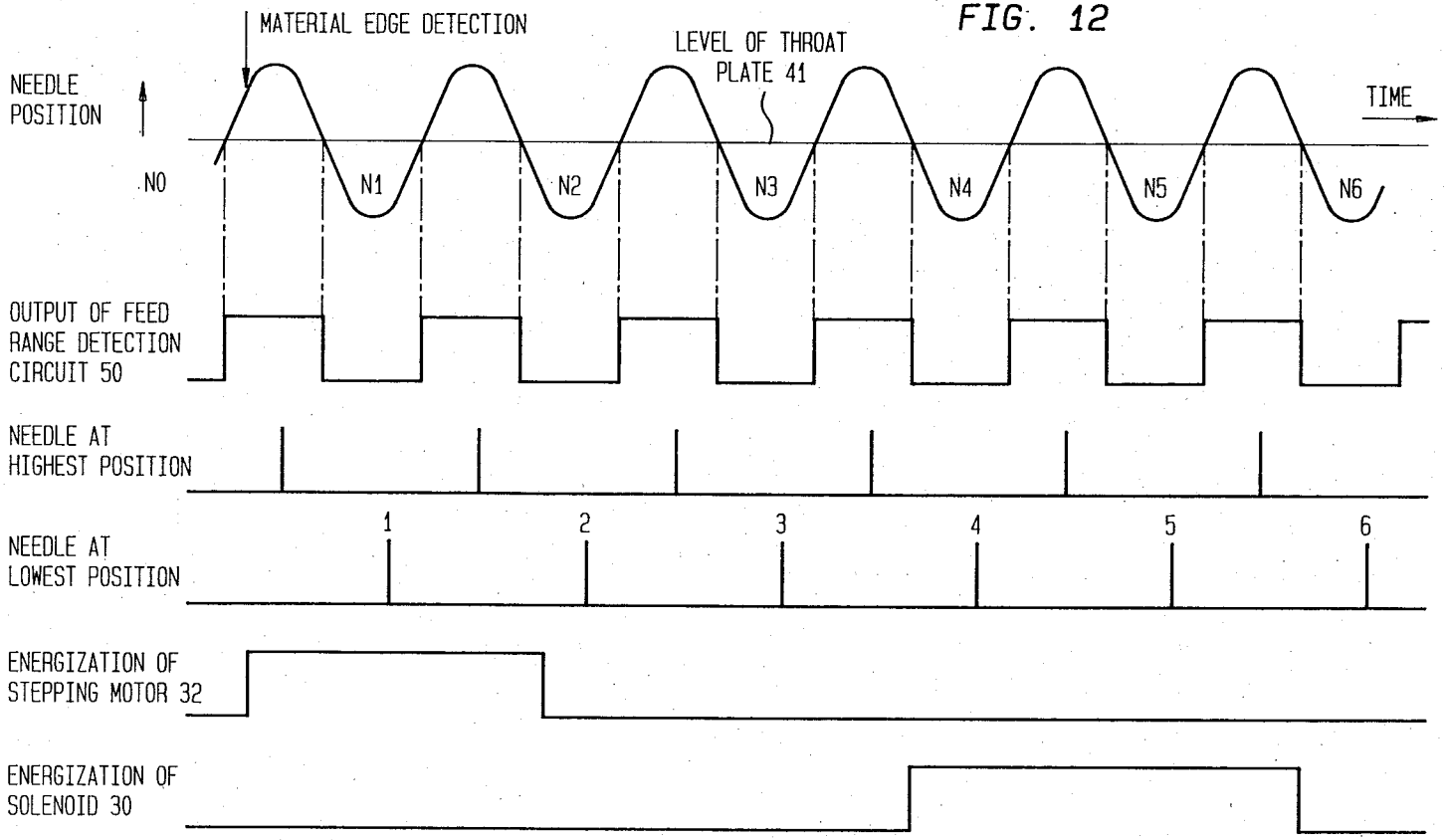

FIGS. 10, 11 and 12, show that the needle is above the throat plate 41 for the first 180° degrees of rotation of the main shaft 11 and below the throat plate 41 for the next 180° of rotation. During the first half-rotation, the feed dog 13 is raised above the throat plate 41 and moves the work forward. During the second half-rotation, the needle is below the throat plate 41, where the upper and lower threads (not shown) are twined in cooperation with the bobbin (not shown). The feed dog is then below the throat plate 41 and moves in the opposite direction to the direction of feed of the work.

When the needle is at or below the throat plate 41, no feed of the work can take place. The output of the feed range detection circuit 50 reflects this; this output is high during the first half-rotation of the main shaft 11 and low during the second half-rotation.

During sewing of the work before detection of the trailing edge, the output of the trailing edge detector circuit 57 is logically high, indicating that the work is present at the photodetector **40*b*. The output of the feed range detection circuit 50 is alternately high and low as the work is fed and sewn, respectively. The pulse detector circuit 51** continues to deliver 160 pulses per rotation of the main shaft.

When the output of the feed range detection circuit 50 goes logically high, the counter 63 (which was previously set to zero) begins to count pulses generated by the pulse detector circuit 51. (The counting can only take place because pulses will only be transmitted to the counter when the AND gate 71 is high, which in turn only happens when the feed dog 13 is feeding the work as evidenced by the high output of the feed range detection circuit 50.) The counter 63 continues to count until the trailing edge of the work is detected and registered as a low output from the trailing edge detector circuit 57. The contents of the counter 63 are then read into the CPU, the OR gate 70 is brought low, and the counter 63 is reset to count from zero.

The last contents of the counter 63, which have been read into the CPU, are then used to determine the percentage of non-accomplishment of feed. The percentage of non-accomplishment of feed is the fraction (L/P) which is indicated in FIG. 11. Physically, this fraction represents the percentage of a normal stitch which has not been fed by the feed dog 13 at the time the trailing edge of the work has been detected. This determination is carried out by reference to a table (FIG. 13) stored in RAM. In this table, the two parameters used are the contents of the counter 63 (the left-hand column) and the initially set stitch pitch (the top row), i.e. the desired normal stitch length. This percentage of non-accomplishment of feed is then used to determine the proper pitch for the last two stitches in the seam.

Figure 14:
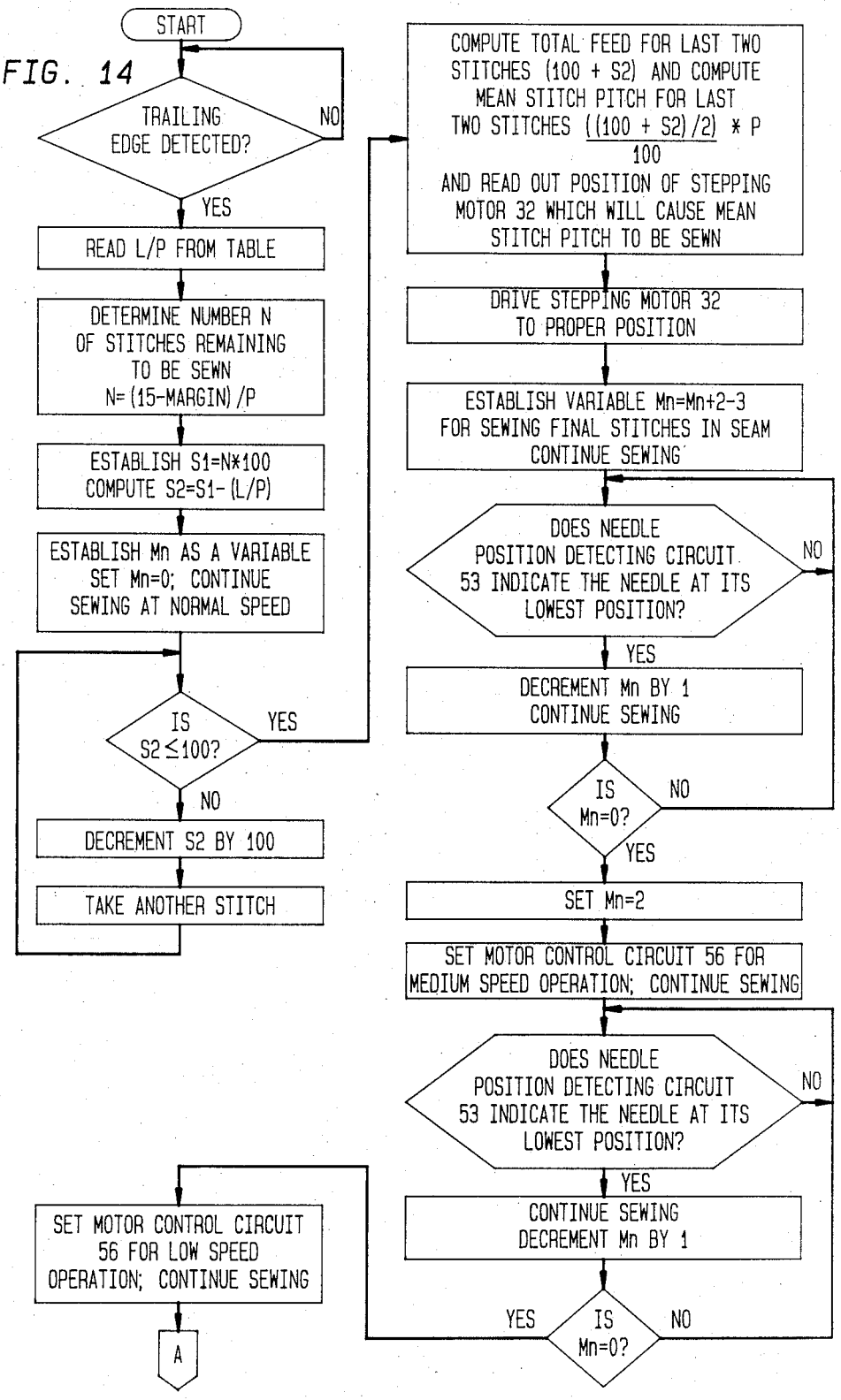
FIG. 14 is a flow chart illustrating the operation of the preferred embodiment at the end of seam.
Figure 14:
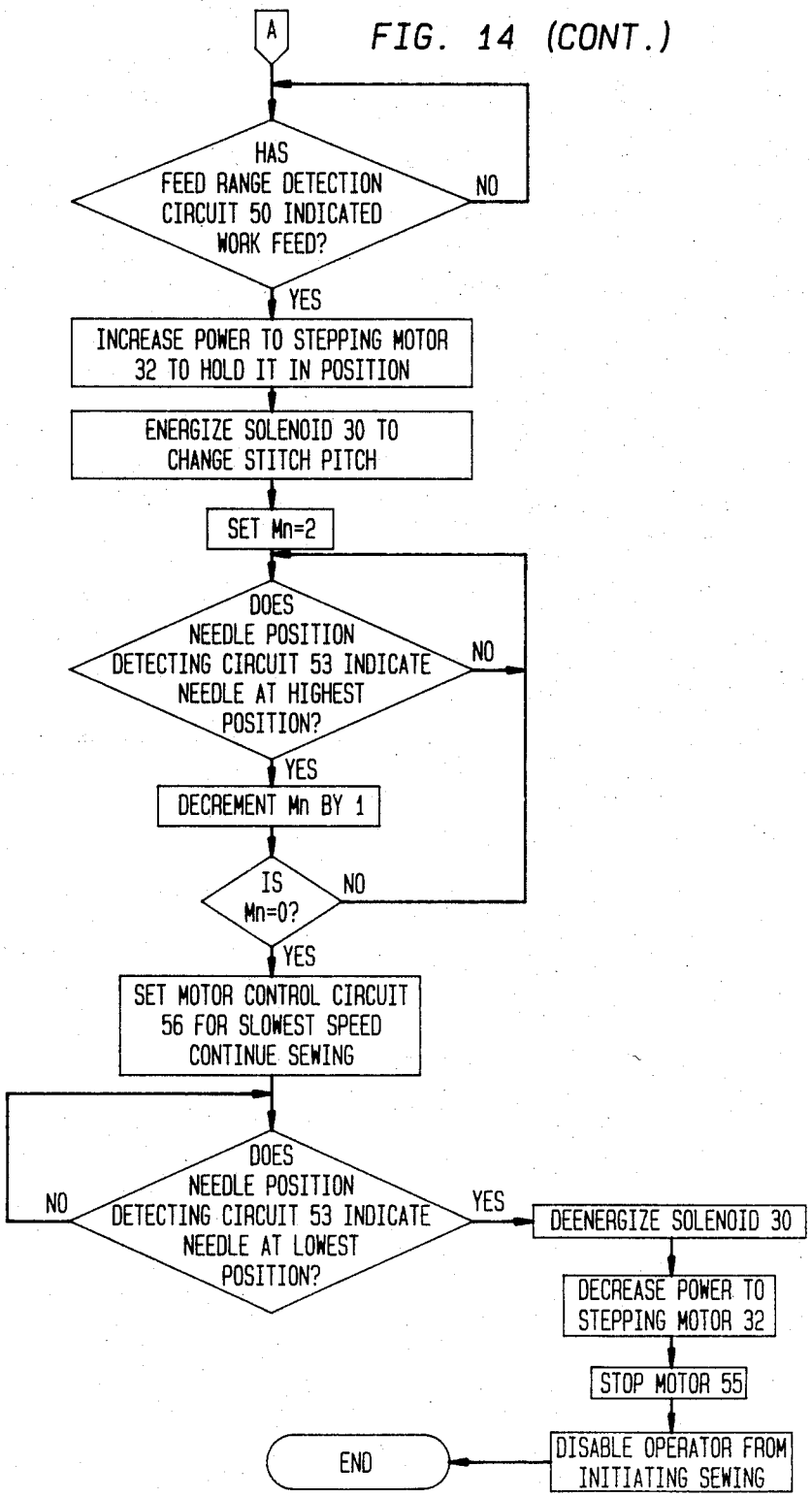

Turning now to FIG. 14, the actual sequence of operations at the end of a seam will be discussed. It is assumed that all necessary data have been entered into the I/O panel 72 and that sewing has proceeded normally under the control of the operator of the machine.

After the trailing edge of the work has been detected, the percentage of non-accomplishment of feed is read out of the FIG. 13 table stored in RAM. The number of remaining stitches is then determined, and a series of computations is carried out to determine the proper position of the stepping motor 32 to achieve the desired stitch pitch of the final two stitches in the seam. Stitching then continues, and the stepping motor 32 is advanced to the proper position. This has no effect on the stitches currently being sewn, because the solenoid 30 is not energized.

During the fifth and fourth stitches from the end of the seam, the machine is operated at a slower speed. During the third stitch, machine speed is further reduced and holding power to the stepping motor 32 is increased preparatory to changing the stitch pitch. The solenoid 30 is then energized. The last two stitches are sewn at the slowest machine speed and the changed stitch pitch, and the machine is stopped with the needle in its lowest position at the end of the seam. The ability of the operator to initiate sewing is disabled, and the process is brought to an end.

It will be appreciated that changes can be made to the preferred embodiment described above. However, such changes do not affect the scope of the invention, which is defined only by the claims which follow:

What is claimed is:

1. A sewing machine stitch control apparatus, comprising:

a feed dog for feeding a workpiece in a forward direction in synchronism with rotation of a main drive shaft of a sewing machine;

regulator means for incrementally regulating the feed of the feed dog in response to motion of a connecting means;

connecting means for providing said motion to the regulator means, the connecting means being movable along a path within a predetermined range and in a predetermined direction;

first driving means for moving the connecting means in said predetermined direction;

setting means being engagable with the connecting means along said path and being displacable along said predetermined direction when so engaged to vary the feed of the feed dog;

second driving means for displacing the setting means and thereby varying said feed of the feed dog:

first circuit means for establishing a time at which the first driving means is to be operated;

second circuit means for establishing a desired displacement by said second driving means; and drive circuit means for driving the second driving means to displace the setting means in an amount established by the second circuit means, before the time established by the first circuit means, and subsequently operating the first driving means after said time, whereby the feed of said feed dog is varied by a desired amount as the connecting means moves along said predetermined direction.

2. A sewing machine stitch control apparatus, comprising:

a feed dog for feeding a workpiece in a forward direction in synchronism with rotation of a main drive shaft of a sewing machine;

regulator means for incrementally regulating the feed of the feed dog in response to motion of a connecting means, manual adjustment means for establishing an initial feed pitch, said manual adjustment means being connected to said regulator means;

connecting means for providing said motion to the regulator means, the connecting means being movable along a path within a predetermined range and in a predetermined direction;

detecting means for detecting a trailing edge of a workpiece, said detecting means being located forwardly of a reciprocating needle of the sewing machine;

first means for generating pulses in synchronism with the rotation of said main drive shaft and for counting said pulses while said feed dog is feeding the workpiece;

second means for determining, from the number of pulses counted by said first means, an amount of feed remaining after a stitch point on the workpiece, upon detection of said trailing edge by said detecting means;

third means for determining a reduced feed pitch which is less than said initial feed pitch, and corresponds to a total feed amount between said stitch point and a predetermined point;

fourth means for computing, from said initial feed pitch and said reduced feed pitch, an average feed pitch;

first driving means for moving the connecting means in said predetermined direction;

setting means being engagable with the connecting means along said path and being displacable along said predetermined direction when so engaged to vary the feed of the feed dog;

second driving means for displacing the setting means and thereby varying said feed of the feed dog;

fifth means for determining, upon detection of said trailing edge by said detecting means, a time at which said first driving means should be operated;

control means for driving the second driving means to displace the setting means to the position corresponding to that feed pitch computed by the fourth means and subsequently driving the first driving means at said time determined by said fifth circuit means.

3. The apparatus claimed in claim 2, wherein said fifth means comprises counting means for determining a first number of stitches required to complete a seam in accordance with said initial feed pitch and said total feed amount, and wherein said control means drives the second driving means when said fifth means has counted a second number of stitches which is determined by said first number of stitches.

4. The apparatus claimed in claim 2, wherein the second driving means comprises a rotatable cam and a pulse motor connected to rotate the cam to engage the connecting means, and wherein the first driving means comprises a solenoid which, when energized, engages the cam and connecting means.

* * * * *